US007195522B2

(12) United States Patent
Okada et al.

(10) Patent No.: US 7,195,522 B2
(45) Date of Patent: Mar. 27, 2007

(54) ELECTRICAL CONNECTOR

(75) Inventors: Akira Okada, Aichi (JP); Toshiaki Hayashi, Aichi (JP)

(73) Assignee: Tyco Electronics Amp K.K., Kanagawa-ken (JP)

( * ) Notice: Subject to any disclaimer, the term of this patent is extended or adjusted under 35 U.S.C. 154(b) by 0 days.

(21) Appl. No.: 11/421,563

(22) Filed: Jun. 1, 2006

(65) Prior Publication Data

US 2006/0281374 A1 Dec. 14, 2006

(30) Foreign Application Priority Data

Jun. 10, 2005 (JP) ..... 2005-170376

(51) Int. Cl.
*H01R 13/514* (2006.01)

(52) U.S. Cl. ..... 439/752

(58) Field of Classification Search ..... 439/572, 439/352, 595, 752

See application file for complete search history.

(56) References Cited

U.S. PATENT DOCUMENTS 4,946,399 A * 8/1990 Kawashima ..... 439/752
5,066,252 A * 11/1991 Kato et al. ..... 439/752
5,122,080 A * 6/1992 Hatagishi et al. ..... 439/595
5,203,722 A * 4/1993 Kinoshita ..... 439/595
5,252,096 A * 10/1993 Okada ..... 439/752
5,299,958 A * 4/1994 Ohsumi ..... 439/752
5,358,427 A * 10/1994 Miwa ..... 439/595
5,503,573 A * 4/1996 Sagawa ..... 439/752
5,782,657 A * 7/1998 Wolla et al. ..... 439/595
5,797,772 A * 8/1998 Sakurai et al. ..... 439/752
5,830,013 A * 11/1998 Saito et al. ..... 439/595
5,885,105 A 3/1999 Takagishi et al.
5,934,946 A * 8/1999 Nakamura ..... 439/752
6,220,886 B1 * 4/2001 Kurimoto ..... 439/352
6,902,443 B2 * 6/2005 Hara et al. ..... 439/752

* cited by examiner

*Primary Examiner*—Tulsidas C. Patel
*Assistant Examiner*—Phuongchi Nguyen
(74) *Attorney, Agent, or Firm*—Barley Snyder LLC

(57) ABSTRACT

An electrical connector comprises a connector housing having a retainer receiving opening and a terminal insertion opening. A retainer is receivable in the retainer receiving opening and has a terminal receiving aperture that substantially aligns with the terminal insertion opening to form a terminal receiving path. The retainer is moveable between a first position and a second position. An elastic lance extends from a lower edge of and substantially beneath the terminal receiving aperture. A shoulder is formed on an upper surface of the terminal receiving aperture opposite from the elastic lance. An engaging claw extending from the elastic lance extends into the terminal receiving path in the first position for temporarily engaging a terminal, and the shoulder extends into the terminal engaging path in the second position for permanently engaging the terminal. The engaging claw is removed from the terminal receiving path in the second position.

16 Claims, 4 Drawing Sheets

ELECTRICAL CONNECTOR

FIELD OF THE INVENTION

The invention relates to an electrical connector. More particularly, invention relates to a structure for fixing terminals within a connector housing.

BACKGROUND OF THE INVENTION

It is known to provide an elastic engaging member, such as a lance, within a connector housing to fix terminals therein. The lance is typically integrally formed with the connector housing, which is formed from an insulative resin. The shape and elasticity of the lance is thereby dictated by the material used to form the connector housing. As a result, there are cases in which the terminals cannot be positively engaged, if the amount of elastic displacement of the lance is insufficient. On the other hand, if the amount of elastic displacement is increased, for example, by lengthening an arm of the lance, a possibility arises that the holding force to fix the terminals becomes insufficient.

In order to solve this problem, a double engaging structure is used to fix the terminals within the connector housing. In the double engaging structure, a lance primarily engages the terminals housed within the connector housing, and a retainer is inserted through an aperture in an outer peripheral wall of the connector housing to secondarily engage the terminals. U.S. Pat. No. 5,885,105 discloses an example of this type of double engaging structure. In this example, a lance is provided on a retainer. The terminals housed within a connector housing are simultaneously engaged with the lance and a stepped portion of the retainer. A window for disengaging the engagement with the terminals is provided at a front end thereof toward terminal insertion openings.

In the above described electrical connector, primary engagement by the lance of the retainer and secondary engagement by the retainer are performed simultaneously. However, fixing and holding of the terminals are mostly borne by the retainer, and the lance contributes very little to the fixing and holding of the terminals. In order to positively engage the terminals with the lance, it is necessary to provide a space that enables a sufficient amount of elastic displacement of the lance, which is a barrier to miniaturization of the connector. Additionally, it is difficult to visually confirm the engagement state of the terminals housed within the connector housing of the electrical connector, and it is therefore difficult to operate a disengaging member, such as a rod-shaped disengaging jig, that is inserted through the windows to release the engagement of the terminals.

BRIEF SUMMARY OF THE INVENTION

It is therefore an object of the present invention to provide an electrical connector which is capable of positively engaging terminals housed within a connector housing without preventing miniaturization of the electrical connector while also improving the operability of the electrical connector during disengagement of the terminals housed therein.

This and other objects are achieved by an electrical connector comprising a connector housing having a retainer receiving opening and a terminal insertion opening. A retainer is receivable in the retainer receiving opening. The retainer has a terminal receiving aperture that substantially aligns with the terminal insertion opening to form a terminal receiving path. The retainer is moveable between a first position where the retainer is partially inserted into the retainer receiving opening and a second position where the retainer is fully inserted into the retainer receiving opening. An elastic lance extends from a lower edge of the terminal receiving aperture substantially beneath the terminal receiving aperture. The elastic lance has an engaging claw extending there from. A shoulder is formed on an upper surface of the terminal receiving aperture opposite from the elastic lance. The engaging claw extends into the terminal receiving path in the first position for temporarily engaging a terminal, and the shoulder extends into the terminal engaging path in the second position for permanently engaging the terminal.

This and other objects are further achieved by an electrical connector comprising a connector housing having a retainer receiving opening and a terminal insertion opening. A retainer is receivable in the retainer receiving opening. The retainer has a terminal receiving aperture that substantially aligns with the terminal insertion. The retainer is moveable between a first position where the retainer is partially inserted into the retainer receiving opening and a second position where the retainer is fully inserted into the retainer receiving opening. A terminal extends through the terminal insertion opening and the terminal receiving aperture. The terminal has a terminal engaging recess and a stepped portion. An elastic lance extends from a lower edge of the terminal receiving aperture substantially beneath the terminal receiving aperture. The elastic lance has an engaging claw extending there from that engages the terminal engaging recess in the first position. A shoulder is formed on an upper surface of the terminal receiving aperture opposite from the elastic lance. The shoulder engages the stepped portion in the second position.

DETAILED DESCRIPTION OF THE INVENTION

Figure 1:
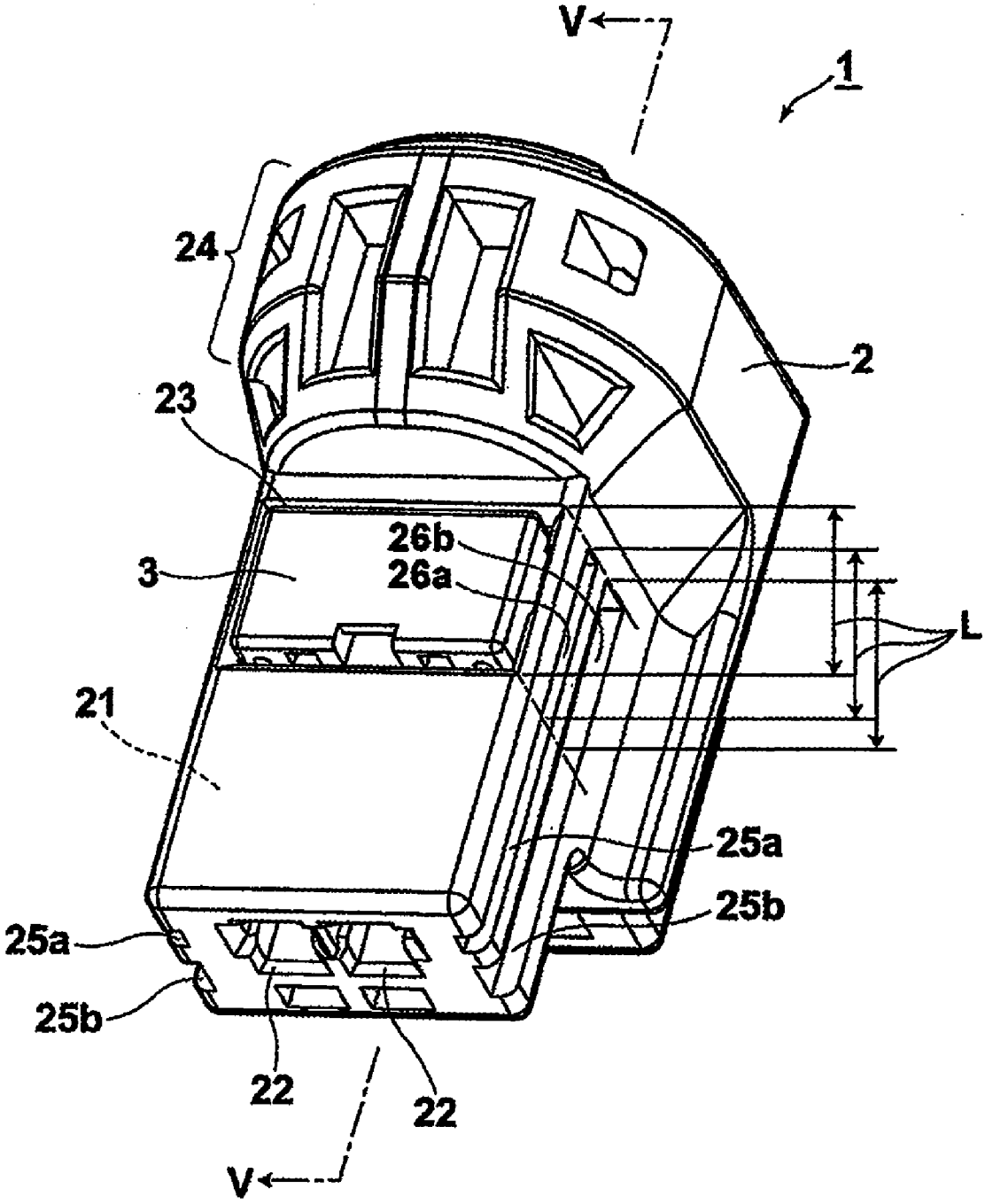
FIG. 1 is a perspective view of an electrical connector according to an embodiment of the invention.

FIG. 1 shows an electrical connector 1 according to an embodiment of the invention. The electrical connector 1 may be used, for example, in an intermediate harness that changes the position of an engagement opening as a squib connector for a seatbelt retractor of an automobile. Hereinafter, a side of the electrical connector 1 facing away from the surface of the drawing sheet of Figure will be referred to as the "front", and the side of the electrical connector 1 facing toward the surface of the drawing sheet of FIG. 1 will be referred to as the "rear". Note that for the sake of convenience, the upper direction in FIG. 1 will be referred to as "up", and the lower direction in FIG. 1 will be referred to as "down".

As shown in FIG. 1, the electrical connector 1 comprises a connector housing 2. The connector housing 2 has a terminal receiving chamber 21. The terminal receiving chamber 21 has terminal insertion openings 22 provided in a rear wall thereof. It will be appreciated by those skilled in the art that while only two of the terminal insertion openings 22 are illustrated, the terminal receiving chamber 21 may have more or less than two of the terminal insertion openings 22. A substantially rectangular retainer receiving opening 23 is formed in an upper wall of the connector housing 2. The upper wall of the connector housing 2 extends substantially perpendicular to the rear wall, such that a lengthwise direction of the retainer receiving opening 23 extends in a horizontal direction. A substantially dome-shaped mating portion 24 formed for mating with a mating connector (not shown) is provided at the front end of the connector housing 2. Substantially parallel grooves 25*a*, 25*b* that are separated from each other in a vertical direction are formed in side walls of the connector housing 2. The grooves 25*a*, 25*b* form upper and lower windows 26*a*, 26*b*, respectively, that communicate with the terminal receiving chamber 21 from ends thereof toward the mating portion 24 for a distance L substantially equal to short sides of the retainer receiving opening 23.

Figure 2A:
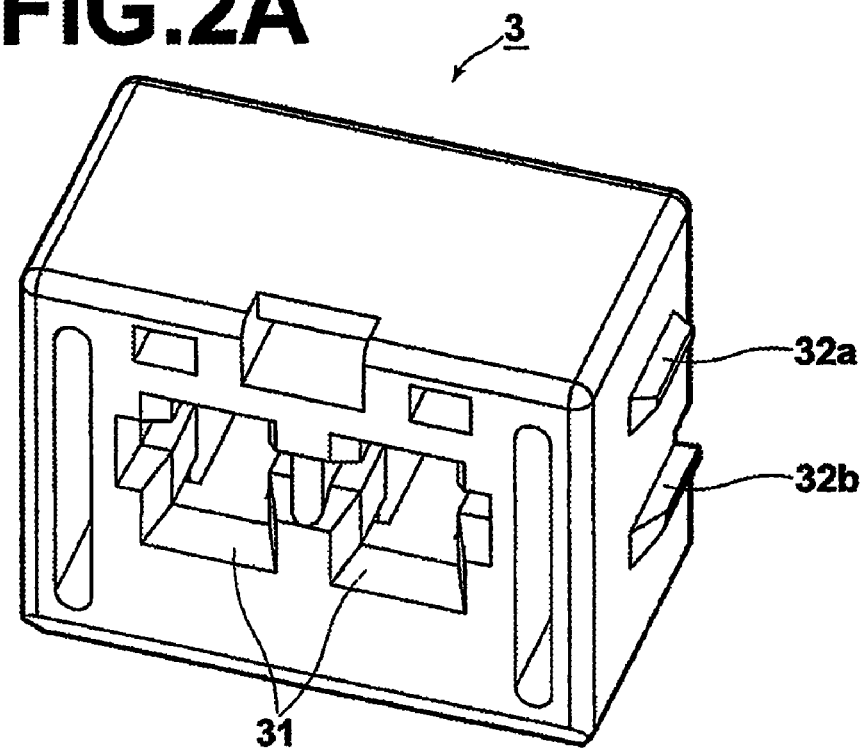
FIG. 2A is a perspective view of a front of a retainer of the electrical connector of FIG. 1.
Figure 2B:
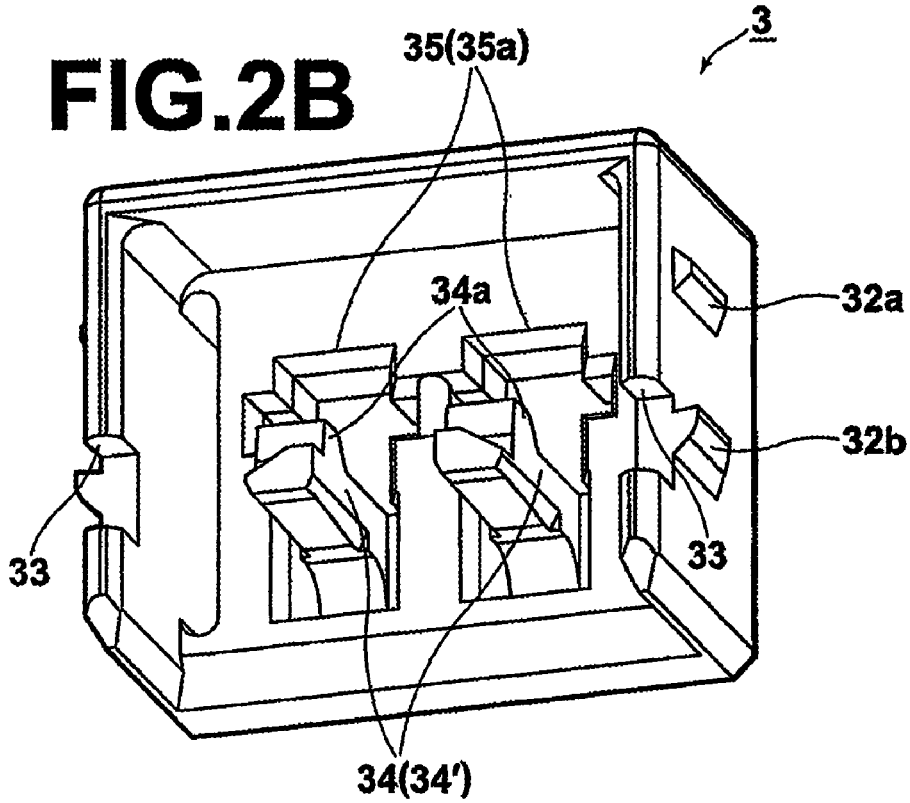
FIG. 2B is a perspective view of a rear of the retainer of the electrical connector of FIG. 1.

A retainer 3 is formed to be removably inserted into the retainer receiving opening 23 of the connector housing 2. As shown in FIGS. 2A–2B, the retainer 3 is formed to be a substantially parallelepiped box and includes an upper wall, side walls, and a rear wall. The upper wall faces outward when the retainer is inserted into the connector housing 2. The side walls face each other via the upper wall. The rear wall extends substantially perpendicular to the upper wall and the side walls and faces inward when the retainer 3 is inserted into the connector housing 2. Hereinafter, the side of the retainer 3 facing away from the surface of the drawing sheet of FIG. 2A (side facing an engagement surface with the mating connector (not shown) when inserted into the connector housing 2) will be referred to as the "front", and the side of the retainer 3 facing toward the surface of the drawing sheet of FIG. 2A (side at which wires (not shown) are connected when inserted into the connector housing 2) will be referred to as the "rear".

As shown in FIG. 2A, terminal receiving apertures 31 are formed in the rear wall of the retainer 3. The terminal receiving apertures 31 are formed such that the terminal receiving apertures 31 align with the terminal insertion openings 22 when the retainer 3 is inserted into the connector housing. As shown in FIG. 2B, vertically separated upper and lower protrusions 32*a*, 32*b*, respectively, are formed on outer surfaces of the side walls. The upper and lower protrusions 32*a*, 32*b* are formed to engage with the upper and lower windows 26*a*, 26*b*, respectively, of the connector housing 2. Cut-outs 33 are formed in the side walls. Each of the cut-outs 33 extends from a front edge of the side wall toward a rear of the side wall and up to the lower protrusion 32*b*.

Figure 4:
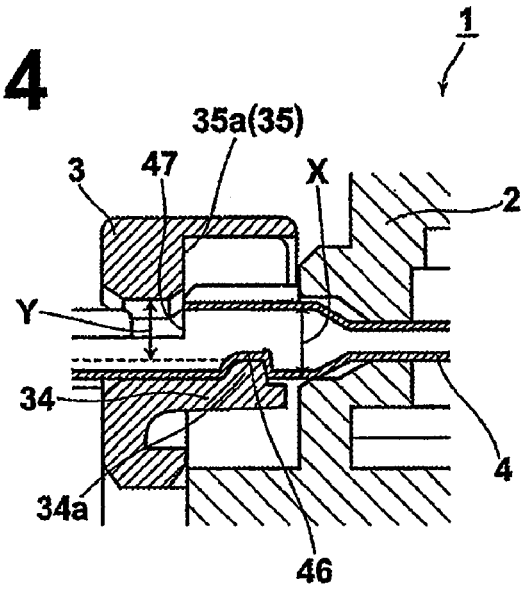
FIG. 4 is a sectional view of the electrical connector of FIG. 1 showing the terminal received therein.

Elastic lances 34' extend from a lower edge of the terminal receiving apertures 31 toward an interior of the retainer 3 such that the elastic lances 34' are provided substantially beneath the terminal receiving apertures 31. An upwardly protruding engaging claw 34*a* that functions as a temporary engaging member 34 is formed on a free end of each of the lances 34'. Shoulders 35*a* are formed on the inner surface of the rear wall and upper surfaces of the terminal receiving apertures 31. The shoulders 25*a* extend substantially perpendicular to the rear wall on a side of the terminal receiving apertures 31 and opposite the temporary engaging members 34. The shoulders 35*a* function as permanent engaging members 35. Thus the temporary engaging members 34 are positioned deeper (lower) than the permanent engaging members 35 in an insertion direction of the retainer 3, and the engaging claws 34*a* protrude upward toward a shallow side. An inner surface of the engaging claw 34*a* of the temporary engaging member 34 is positioned a distance Y from an inner surface of the shoulder 35*a* of the permanent engaging member 35, as shown in FIG. 4.

A terminal 4 is received in the connector housing 2 from the rear thereof. The terminal 4 is inserted into the rear of the connector housing in a direction indicated by the arrow in FIG. 3. The side of the terminal 4 at a right side of the drawing sheet will be referred to as the "front", and the side of the terminal 4 at a left side of the drawing sheet will be referred to as the "rear".

Figure 3:
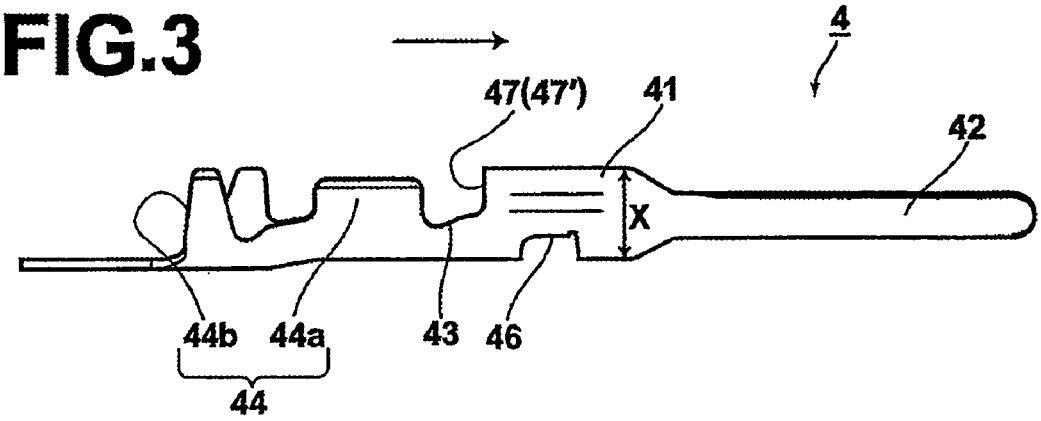
FIG. 3 is a side view of a terminal that is received in the electrical connector of FIG. 1.

The terminal 4 is formed by punching and bending a metal plate. As shown in FIG. 3, the terminal 4 includes a contact member 42 that extends from a front of a locking member 41, and a crimp barrel 44 that extends from a rear of the locking member 41 and is connected thereto by a linking member 44. The crimping barrel 44 is provided for crimping an end of the wire (not shown). The crimp barrel 44 comprises a conductor barrel 44*a* for crimping a conductor of the wire (not shown) and an insulation barrel 44*b* for crimping an insulative covering of the wire (not shown). A temporary engaging recess 46 formed for engaging the engaging claw 34*a* is formed in a surface of the angular cylindrical portion 41 at substantially a center of the terminal 4 in the direction of insertion thereof. A stepped portion 47' is formed on the locking member 41 facing toward the linking member 43 and functions as a permanent engaging member 47 for engaging the shoulder 35*a*. The terminal 4 has a width X, which extends in the same direction as the distance Y and is larger than the distance Y.

Figure 5:
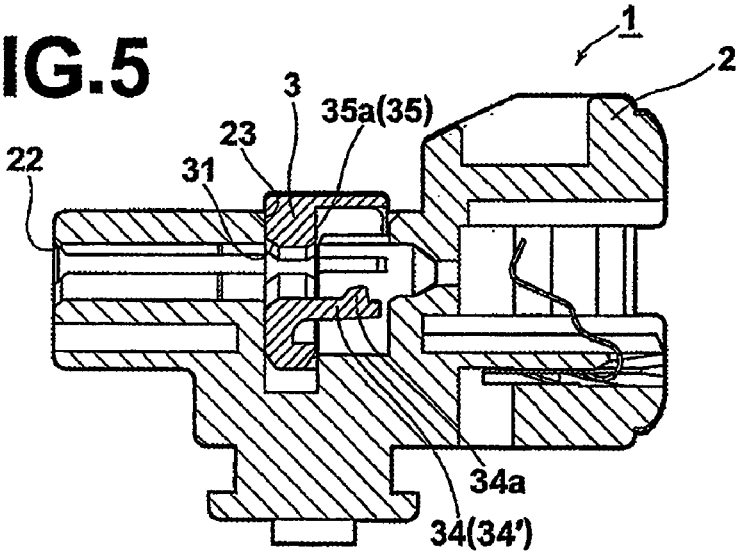
FIG. 5 is a sectional view taken along line V—V of FIG. 1 showing the electrical connector prior to insertion of the terminal therein.

The method of inserting the retainer 3 into the connector housing 2 and fixing the terminal 4 therein will now be described. As shown in FIG. 1, the retainer 3 is inserted into the retainer receiving opening 23 of the connector housing 2 so that the lower protrusions 32*b* on the retainer 3 engage the upper windows 26*a* of the connector housing 2 to hold the retainer 3 at a first position, in which the retainer 3 is shallowly inserted in the retainer receiving opening 23. In the first position, the terminal insertion openings 22 of the connector housing 2 and the terminal receiving apertures 31 of the retainer 3 are maintained in an aligned state for smooth insertion of the terminals 4 into the connector housing 2, as shown in FIG. 5.

Figure 6:
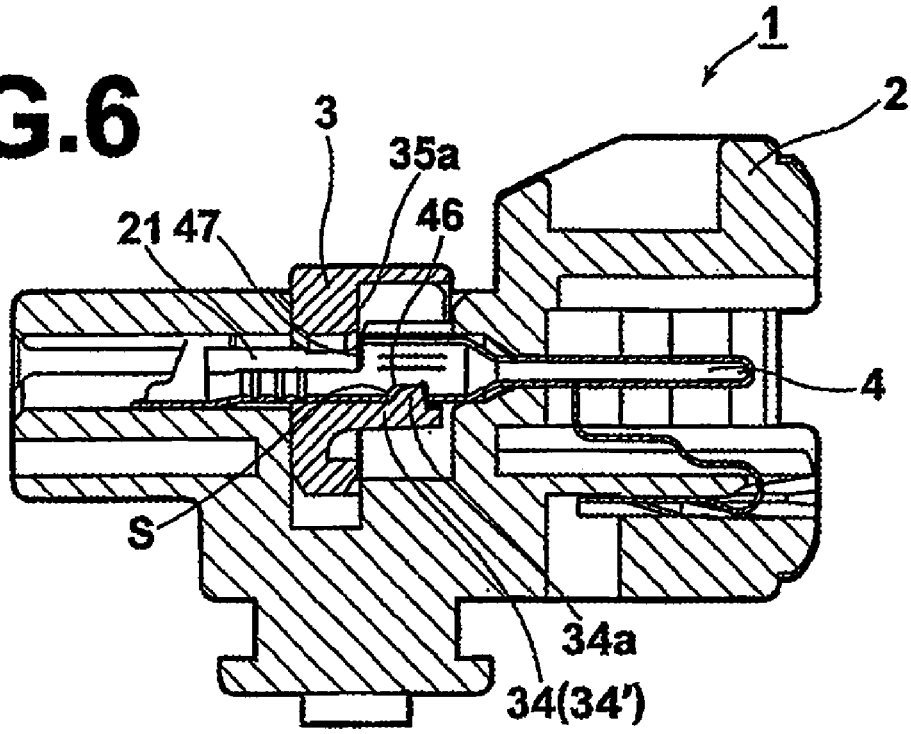
FIG. 6 is a sectional view taken along line V—V of FIG. 1 showing the electrical connector when the terminal is temporarily engaged therein.

The terminals 4 are inserted into the connector housing 2. As the terminals are inserted, the terminals 4 press the engaging claws 34*a* of the temporary engaging members 34 downward into the terminal receiving chamber 21. When the terminals 4 reach a predetermined position, the engaging claws 34*a* return to their original positions and engage the temporary engaging recesses 46 of the terminals 4, as shown in FIG. 6. This is the temporarily engaged state between the temporary engaging members 34 and the terminals 4 where the temporary engaging members 34 are positioned deeper (lower) than the permanent engaging members 35 in the direction of insertion of the retainer 3 and the engaging claws 34*a* protrude upward toward the shallow side such that gaps S are formed between the engaging claws 34*a* and the temporary engaging recesses 46. The terminals 4 are therefore only temporarily engaged when the retainer 3 is in the first position. By temporarily engaging the terminals 4 in this manner, even in the case that wires (not shown), which are crimped onto the terminals 4 are pulled, movement of the terminals 4 is restricted. Accordingly, the terminals 4 are not easily pulled out of the connector housing 2.

Figure 7:
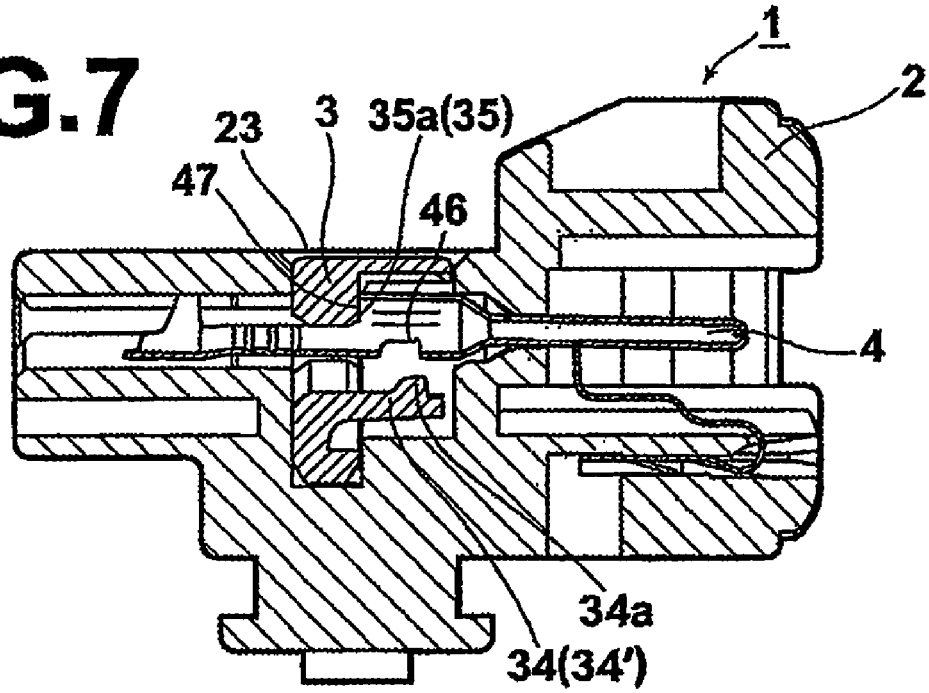
FIG. 7 is a sectional view taken along line V—V of FIG. 1 showing the electrical connector when the terminal is permanently engaged therein.

When the retainer 3 is inserted deeper into the retainer receiving opening 23 from the first position, the upper and lower protrusions 32*a*, 32*b* of the retainer 3 engage the upper and lower windows 26*a*, 26*b* of the connector housing 2, respectively, to positively hold the retainer 3 in a second position, in which the retainer 3 is completely inserted into the connector housing 2, as shown in FIG. 7. The distance Y, from the inner surface of the engaging claw 34*a* of the temporary engaging member 34 to the inner surface of the shoulder 35*a* of the permanent engaging member 35, is smaller than the width X of the terminal 4, as shown in FIG. 4. Permanent engagement of the terminals 4 by the permanent engaging members 35 is therefore initiated prior to release of the temporary engagement of the terminals 4 by the temporary engaging members 34. Thus, when the retainer 3 is in the second position, the temporary engagement of the terminals 4 by the temporary engaging members 34 is completely disengaged, and the permanent engaging members 47 of the terminals 4 are engaged by the shoulders 35*a*, as shown in FIG. 7. This is the permanently engaged state between the permanent engaging members 35 and the terminals 4.

By adopting this structure, the terminals 4 can be positively engaged, even if the amount of elastic displacement of the lances 34' or temporary engaging members 34 is less than that of conventional electrical connectors. Accordingly, the necessity of increasing the displacement space for the temporary engaging members 34 is obviated, which is advantageous from the viewpoint of miniaturization of the electrical connector 1. Because it is not necessary to lengthen the temporary engaging members 34 in order to secure an amount of elastic displacement, the risk of breakage decreases, and the holding force during temporary engagement of the terminals 4 can be increased. In addition, the terminals 4 are maintained in a state in which they are engaged by at least either the temporary engaging members 34 or the permanent engaging members 35, by being sandwiched there between from two opposing directions. Accordingly, the possibility of the terminals 4 being extracted from the connector housing 2 can be reduced.

When the terminals 4 are to be extracted from the terminal receiving chamber 21, the retainer 3 is pulled back into the first position. A disengaging member (not shown), such as a substantially rod-shaped disengaging jig, is inserted through the upper windows 26*a* of the connector housing 2 and the cut-outs 33 of the retainer 3 and is received in the gaps S, as shown in FIG. 6. The temporary engaging members 34 are flexed downward to release the engagement between the engaging claws 34 and the temporary engaging recesses 46. When the engaging claws 34*a* are disengaged from the temporary engaging recesses 46, the terminals 4 can be easily removed from the retainer 3 and the connector housing 2. The upper windows 26*a* and the cut-outs 33 are provided in the side walls that face each other with the temporary engaging members 34 there between. The positions of the gaps S therefore can be visually confirmed while inserting and operating the disengaging member (not shown), thereby facilitating release of the temporary engagement.

While the foregoing illustrates some of the possibilities for practicing the invention, many other embodiments are possible within the scope and spirit of the invention. It is, therefore, intended that the foregoing description be regarded as illustrative rather than limiting, and that the scope of the invention is given by the appended claims together with their full range of equivalents. For example, the distance Y may be equal to the width X. In this case, permanent engagement by the permanent engaging members 35 is initiated simultaneously with the release of the temporary engagement of the terminals 4 by the temporary engaging members 34. Additionally, the upper and lower windows 26*a*, 26*b* and the cut-outs 33 may be only provided on one of the side walls, as long as the release of the engagement of the terminal 4 is enabled.

In the electrical connector of the present invention as described above, the retainer 3 comprises the temporary engaging member 34, for temporarily engaging the terminal 4, and the permanent engaging member 35, for permanently engaging the terminal 4. The need to provide a lance on the connector housing 2 is therefore obviated, and the material thereof is free from restrictions. Accordingly, in the case that high mechanical strength is required of the connector housing 2, a resin having poor elasticity, such as polybutylene terephthalate (PBT), which has glass fibers incorporated therein, may be used to form the connector housing 2 in order to increase the mechanical strength thereof.

The retainer 3 comprises the elastic temporary engaging member 34, for temporarily engaging the terminal 4, and the permanent engaging member 35, for permanently engaging the terminal 4. The necessity of providing a large space for receiving the permanent engaging member 35 when the permanent engaging member 35 is elastically displaced is therefore obviated. Accordingly, factors that prevent miniaturization of the electrical connector 1 are reduced. In addition, sufficient strength to permanently engage the terminal 4 is provided such that the permanent engaging member 35 can positively hold the terminal 4.

When the retainer 3, which is in permanent engagement with the terminal 4, the retainer 3 is also engaged with the connector housing 2 in the second position, and therefore the engagement of the terminal 4 can be strengthened. The permanent engagement is accomplished by the permanent engaging member 35. The terminal 4 can therefore be positively engaged, even if the amount of elastic displacement of the temporary engaging member 34 is less than that of conventional electrical connectors. Accordingly, the necessity of increasing the displacement space for the temporary engaging member 34 is obviated, which is advantageous from the viewpoint of miniaturization of the electrical connector 1. In addition, as it is not necessary to lengthen the temporary engaging member 34 in order to have a large enough space to allow for elastic displacement thereof, the risk of breakage decreases, and the holding force during temporary engagement of the terminal 4 can be increased.

The permanent engaging member 35 is provided on the side of the terminal receiving aperture 31 opposite the temporary engaging member 34, and the temporary engagement by the temporary engaging member 34 with the terminal 4, which occurs when the retainer 3 is in the first position, is completely disengaged when the retainer 3 is in the second position, and the terminal 4 is permanently engaged by the permanent engaging member 35. The terminal 4 can therefore be maintained in a state in which the terminal 4 is engaged by either the temporary engaging member 34 or the permanent engaging member 35, by being positioned there between. Accordingly, the possibility of the terminal 4 being extracted from the connector housing 2 can be reduced.

What is claimed is:

1. An electrical connector, comprising:

a connector housing having a retainer receiving opening and a terminal insertion opening;

a retainer receivable in the retainer receiving opening, the retainer having a terminal receiving aperture that substantially aligns with the terminal insertion opening to form a terminal receiving path, the retainer being moveable between a first position where the retainer is partially inserted into the retainer receiving opening and a second position where the retainer is fully inserted into the retainer receiving opening;

an elastic lance extending from a lower edge of the terminal receiving aperture substantially beneath the terminal receiving aperture, the elastic lance having an engaging claw extending there from, the engaging claw extending into the terminal receiving path in the first position for temporarily engaging a terminal; and a shoulder formed on an upper surface of the terminal receiving aperture opposite from the elastic lance, the shoulder extending into the terminal engaging path in the second position for permanently engaging the terminal.

2. The electrical connector of claim 1, wherein the connector housing is a polybutylene terephthalate material.

3. The electrical connector of claim 1, wherein the connector housing includes a mating portion, the retainer receiving opening being positioned between the mating portion and the terminal insertion openings.

4. The electrical connector of claim 1, wherein the engaging claw is removed from the terminal receiving path in the second position.

5. The electrical connector of claim 4, wherein the shoulder is removed from the terminal receiving path in the first position.

6. The electrical connector of claim 1, wherein the retainer includes a cut-out that exposes the engaging claw and the connector housing includes upper and lower window that align with the cut-out.

7. The electrical connector of claim 6, wherein the retainer includes upper and lower protrusions that engage with the upper and lower windows to position the retainer in the first and second positions.

8. An electrical connector, comprising:

a connector housing having a retainer receiving opening and a terminal insertion opening;

a retainer receivable in the retainer receiving opening, the retainer having a terminal receiving aperture that substantially aligns with the terminal insertion opening, the retainer being moveable between a first position where the retainer is partially inserted into the retainer receiving opening and a second position where the retainer is fully inserted into the retainer receiving opening;

a terminal extending through the terminal insertion opening and the terminal receiving aperture, the terminal having a terminal engaging recess and a stepped portion;

an elastic lance extending from a lower edge of the terminal receiving aperture substantially beneath the terminal receiving aperture, the elastic lance having an engaging claw extending there from that engages the terminal engaging recess in the first position; and a shoulder formed on an upper surface of the terminal receiving aperture opposite from the elastic lance, the shoulder engaging the stepped portion in the second position.

9. The electrical connector of claim 8, wherein the connector housing is a polybutylene terephthalate material.

10. The electrical connector of claim 8, wherein the connector housing includes a mating portion, the retainer receiving opening being positioned between the mating portion and the terminal insertion openings.

11. The electrical connector of claim 8, wherein the terminal engaging recess and the stepped portion are formed on a locking member of the terminal, the locking member having a width larger than a distance between an inner surface of the engaging claw an inner surface of the shoulder.

12. The electrical connector of claim 8, wherein a gap for receiving a disengaging member is formed between the engaging claw and the terminal engaging recess when the engaging claw is received therein.

13. The electrical connector of claim 8, wherein the engaging claw is removed from the terminal engaging recess in the second position.

14. The electrical connector of claim 13, wherein the shoulder is removed from the terminal receiving path in the first position.

15. The electrical connector of claim 8, wherein the retainer includes a cut-out that exposes the engaging claw and the connector housing includes upper and lower window that align with the cut-out.

16. The electrical connector of claim 15, wherein the retainer includes upper and lower protrusions that engage with the upper and lower windows to position the retainer in the first and second positions.

* * * * *